US006227209B1

(12) United States Patent
Kim et al.

(10) Patent No.: US 6,227,209 B1
(45) Date of Patent: May 8, 2001

(54) ARTICLE FOR ORAL CARE

(76) Inventors: Dae S. Kim; Gil Hee Ko Kim, both of 28031 Ridgebrook Ct., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/451,026

(22) Filed: Nov. 29, 1999

(51) Int. Cl.[7] ..... A45D 44/18

(52) U.S. Cl. ..... 132/308; 132/311; 401/124; 401/126

(58) Field of Search ..... 132/308, 311; 401/123, 124, 125, 126, 127, 129

(56) References Cited

U.S. PATENT DOCUMENTS

| | | | | |
|---|---|---|---|---|
| 793,259 | * | 6/1905 | Wilson | 401/124 |
| 1,374,330 | * | 4/1921 | Stevenson | 132/308 |
| 2,199,877 | * | 5/1940 | Cervera | 132/308 |
| 2,845,645 | * | 8/1958 | Wishnefsky et al. | 132/308 |
| 2,868,215 | * | 1/1959 | Mechem | 401/123 |
| 4,275,750 | * | 6/1981 | Clark | 132/311 |

* cited by examiner

*Primary Examiner*—Pedro Philogene
(74) *Attorney, Agent, or Firm*—John K. Park; Park & Sutton LLP

(57) ABSTRACT

An article for oral care comprises a housing and a tooth paste section. The housing has a first opening, a second opening, a front end, a rear end, and a cavity communicating with the first opening and the second opening. The first opening is formed through the front end and a conventional tooth paste tube with a neck can be inserted through the second opening into the cavity. The neck of the tooth paste tube is removably fixed through the first opening while securely holding the tooth paste tube within the housing, and wherein the tooth paste tube can be squeezed through the second opening to allow a desired amount of the tooth paste to flow out of the neck. The tooth brush section having a base, a connecting rod, and a brush. The base comprises a tube end and a brush end. The tube end has a threaded female bore so that the threaded female bore can be tightly fitted over the neck of the tooth paste tube to securely attach the tooth brush section to the housing.

24 Claims, 3 Drawing Sheets

10
12
14
16
18
20
22
24
26
28
29
30
32
34
36
38
40
42
44
46
47
48
50
52
54
55
56
58
60
62

ARTICLE FOR ORAL CARE

BACKGROUND OF THE INVENTION

The present invention relates to a combination article of a tooth brush and a tooth paste. More specifically, the present invention relates to an improved oral care article combining a tooth brush and a tooth paste, which enhances portability and usability.

Though various types of portable tooth brush sets are on the market, users demand further convenience for such oral care articles. To meet the need, a combination article of a tooth brush and a tooth paste has to be easy to use and convenient to handle. Also, it would be better if a conventional tooth paste tube can be utilized for such a combination article.

There is, therefore, a strong need for an oral care article combining a tooth brush and a tooth paste which can be used easily and conveniently for oral cleansing outdoors as well as indoors.

SUMMARY OF THE INVENTION

The present invention is contrived to overcome the conventional disadvantages. Accordingly, it is an object of the present invention to provide an article for oral care which realizes an ideal combination between a tooth brush and a tooth paste.

Another object of the present invention is to provide an article for oral care which substantially improves usability and portability.

To achieve the above-described objects and others, an article for oral care according to the present invention comprises a housing and a tooth brush section. The housing has a first opening, a second opening, a front end, a rear end, and a cavity communicating with the first opening and the second opening. The first opening is formed through the front end, and a conventional tooth paste tube with a neck may be inserted through the second opening into the cavity. The neck of the tooth paste tube is removably fixed through the first opening while securely holding the tooth paste tube within the housing. The tooth paste tube can be squeezed through the second opening to allow a desired amount of the tooth paste to flow out of the neck.

The tooth brush section has a base, a connecting rod, and a brush. The base comprises a tube end and a brush end. The tube end has a threaded female bore so that the threaded female bore can be tightly fitted over the neck of the tooth paste tube to securely attach the tooth brush section to the housing. The connecting rod is fixedly attached to the base at the brush end and the brush is fixedly attached to the connecting rod.

In a preferred version, the article further comprises an elongate cap for covering the tooth brush section, wherein the elongate cap has a cap opening and an opening rim. At least one boss may be formed on and along an inner periphery of the opening rim so that the opening rim can be detachably fitted onto the front end of the housing adjacent to the first opening.

The elongate cap comprises a clip having a clip base and a clip arm, wherein the clip base is fixedly attached to a predetermined portion of an outer periphery of the elongate cap. The clip arm is elastically elongated toward the housing. Alternately, the clip may be formed on the housing.

The housing further comprises a front extension and a rear extension opposed to the front extension. Here, the front and rear extensions are respectively protruded in a decremental step from the front and rear ends so that the respective outer peripheries of the extensions can detachably carry thereon the opening rim of the elongate cap.

The second opening has a length and a width, wherein the width is about one third the outer circumference of the housing and the length is about two thirds the distance between the front end and the rear end of the housing.

In another version, the front end of the housing has a pair of protrusions elastically approaching toward each other, forming a hiatus between the pair of protrusions, while channeling the first opening and the second opening.

Preferably, the housing may have a rear opening so that a conventional tooth paste tube with a neck can be inserted through the rear opening into the cavity.

According to still another version, the housing comprises a front end, a rear end, a neck with a neck opening, and a second opening. The neck is threaded on and along an outer periphery thereof and formed extending from the front end. The housing further comprises a flexible side cover to tightly seal the second opening so that a selected amount of tooth paste stored within the housing can be squeezed to flow out of the neck opening by pushing the flexible side cover.

The advantages of the article for oral care are numerous. First, the article enables a conventional tooth paste tube to partially serve as a handle of the tooth brush, thereby realizing compactablility. Second, the threaded neck of the conventional tooth paste tube may be utilized for detachable but safe connection between the tooth brush section and the housing, thereby improving usability. Third, the simplified overall construction of the article for oral car according to the present invention may be further added by a clip, thereby enhancing portability.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

Figures 1, 2:
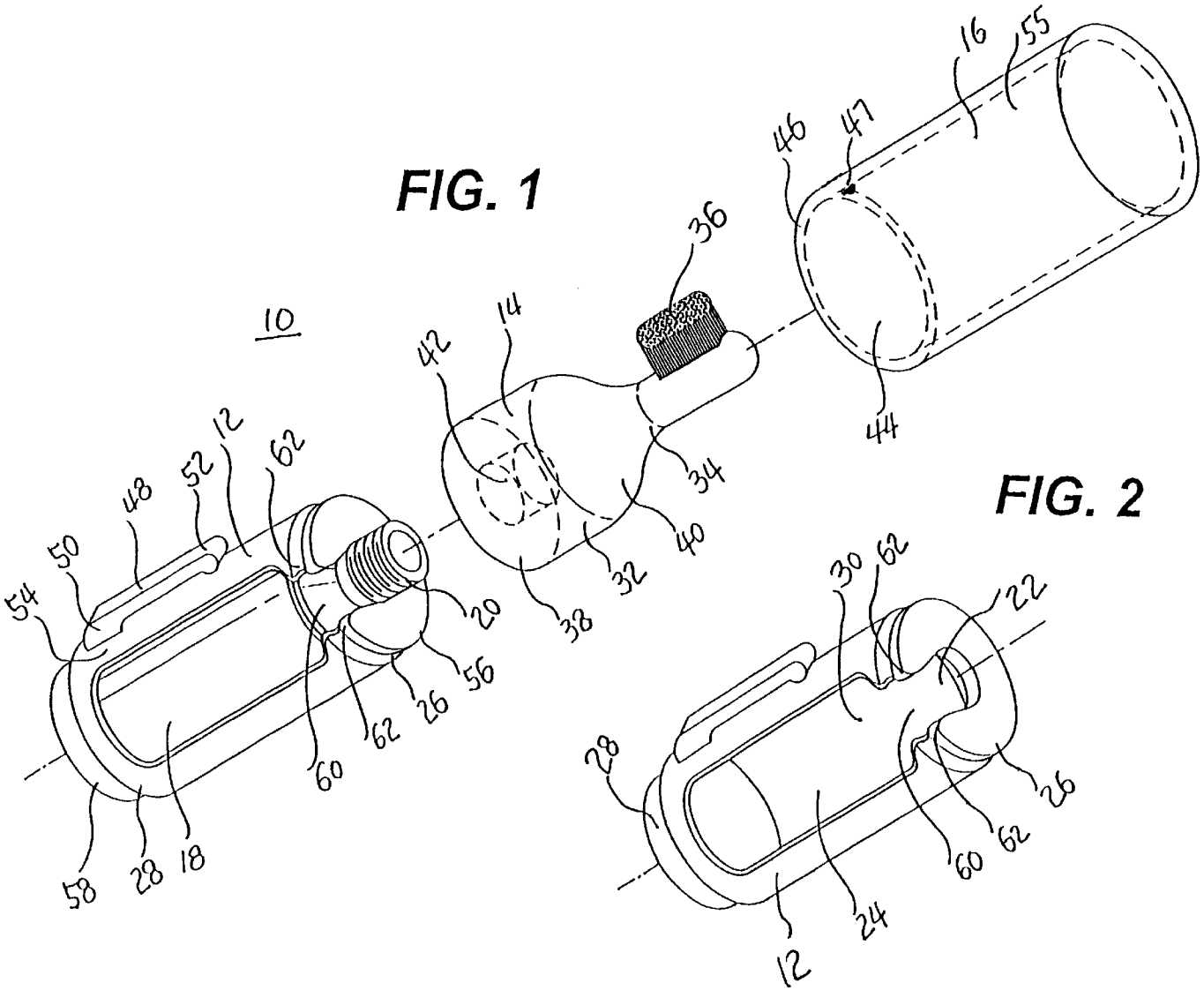
FIG. 1 is a perspective assembly view illustrating an article for oral care according to an embodiment of the present invention.
FIG. 2 is a perspective view illustrating a housing in FIG. 1.

As shown in FIG. 1, an article 10 for oral care according to an embodiment of the present invention comprises a housing 12, a tooth brush section 14 and an elongate cap 16. The housing 12 is sized and shaped in an elongate form to house therein a conventional tooth paste tube 18 having a neck 20.

Referring to FIG. 2, the housing 12 has a first opening 22, a second opening 24, a front end 26, a rear end 28, and a cavity 30. The cavity 30 communicates with the first opening 22 and the second opening 24. The first opening 22 is formed through the front end 26. For tube insertion, the conventional tooth paste tube 18 can be directed through the second opening 24 into the cavity 30 and then the neck 20 is released from the cavity 30 out of the first opening 22 until the neck 20 is tightly fitted within the first opening 22. Specifically, the neck 20 of the tooth paste tube 18 is removably fixed through the first opening 22 while securely holding the tooth paste tube 18 within the housing 12.

To take tooth paste out of the housed tooth paste tube 18, the tooth paste tube 18 can be squeezed through the second opening 24 to allow a desired amount of the tooth paste to flow out of the neck 20. Here, a user's finger may be preferably employed for the squeezing.

The tooth brush section 14 has a base 32, a connecting rod 34, and a brush 36. The base 32 comprises a tube end 38 and a brush end 40. The tube end 38 has a threaded female bore 42 so that the threaded female bore 42 can be tightly fitted over the neck 20 of the tooth paste tube 18 so as to securely attach the tooth brush section 14 to the housing 12.

Also, the connecting rod 34 is fixedly attached to the base 32 at the brush end 40 and the brush 36 is fixedly attached to the connecting rod 34.

The elongate cap 16 is provided to cover the tooth brush section 14. The elongate cap 16 has a cap opening 44 through which the tooth brush section 14 is securely housed. The elongate cap 16 also has an opening rim 46 at the cap opening 44.

Preferably, at least one boss 47 may be formed on and along an inner periphery of the opening rim 46 so that the opening rim 46 can be detachably fitted onto the front end 26 of the housing 12 adjacent to the first opening 22.

For a better performance, the housing 12 further comprises a clip 48 having a clip base 50 and a clip arm 52. The clip base 50 is fixedly attached to a predetermined portion 54 of an outer periphery of the housing 12, wherein the clip arm 52 is elastically elongated toward the tooth brush section 14.

Alternately, the elongate cap 16 may further comprise a clip 48 (not shown but same as the clip 48 on the housing 12) having a clip base 50 and a clip arm 52. The clip base 50 is fixedly attached to a predetermined portion 55 of an outer periphery of the elongate cap 16, wherein the clip arm 52 is elastically elongated toward the housing 12.

In an improvement of the present invention, the housing 12 further comprises a front extension 56 and a rear extension 58 opposed to the front extension 56, wherein the front extension 56 is protruded in a decremental step from the front end 26 so that an outer periphery of the front extension 56 can detachably carry thereon the opening rim 46 of the elongate cap 16.

On the other hand, the rear extension 58 is protruded in a decremental step from the rear end 28 of the housing 12 so that an outer periphery of the rear extension 58 can detachably carry thereon the opening rim 46 of the elongate cap 16.

The second opening 24 has a length and a width, wherein the width is about one third the outer circumference of the housing 12 and the length is about two thirds the distance between the front end 26 and the rear end 28 of the housing 12.

In another embodiment, the housing 12 further comprises a hiatus 60 communicating the first opening 22 and the second opening 24. Specifically, the front end 26 of the housing 12 may have a pair of protrusions 62 elastically approaching toward each other, forming the hiatus 60 between the pair of protrusions 62 while channeling the first opening 22 and the second opening 24. Consequently, the conventional tooth paste tube 18 with the neck 20 can be inserted through the second opening 24 and elastically through the hiatus 60 into the cavity 30. The hiatus 60 is formed by the pair of the protrusions 62 which provide elasticity. That is, the hiatus 60 can be elastically widened when the tube 18 passes therethrough for insertion.

Figure 3:
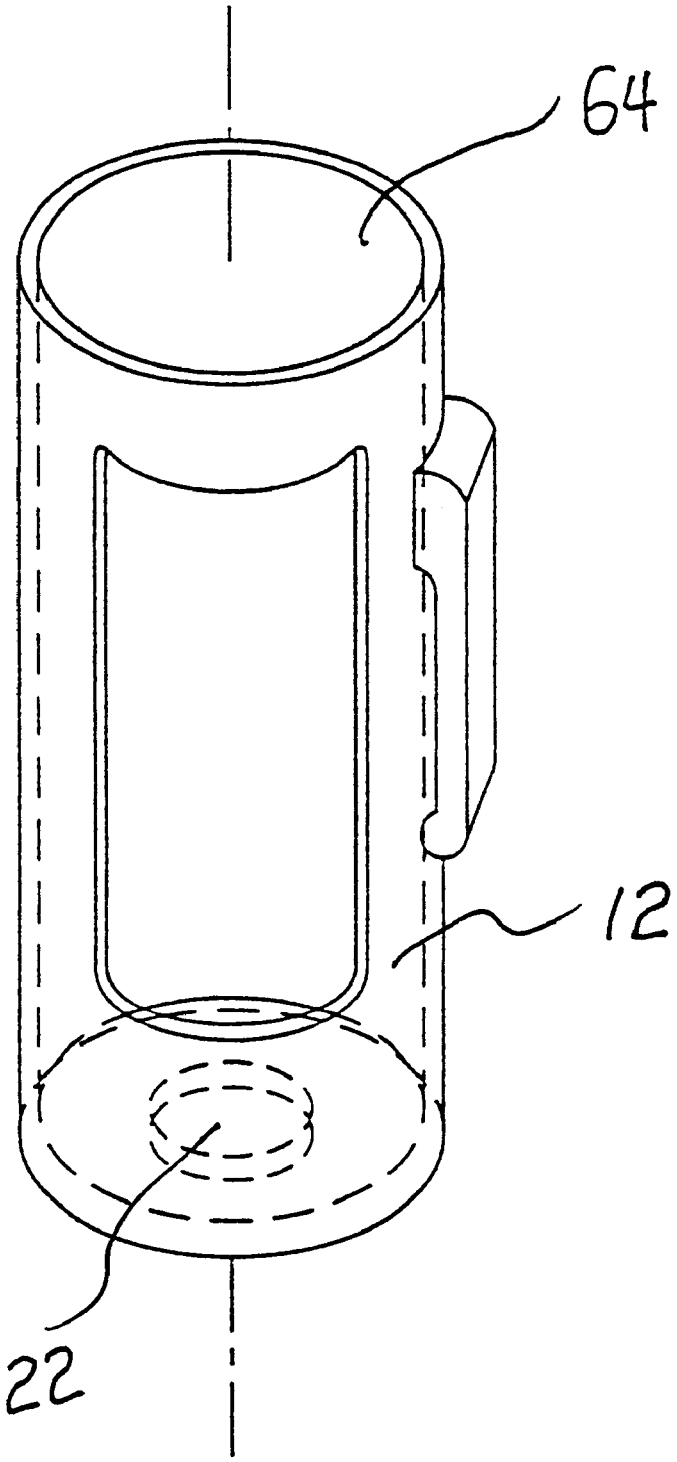
FIG. 3 is a perspective view illustrating another housing according to another embodiment of the present invention.

As illustrated in FIG. 3, a housing 12 according to another embodiment further comprises a rear opening 64 formed through the rear end 28. The rear opening 64 substantially receives the tooth paste tube 18 therethrough. The rear opening 64 is formed larger than the first opening 22.

Figure 4:
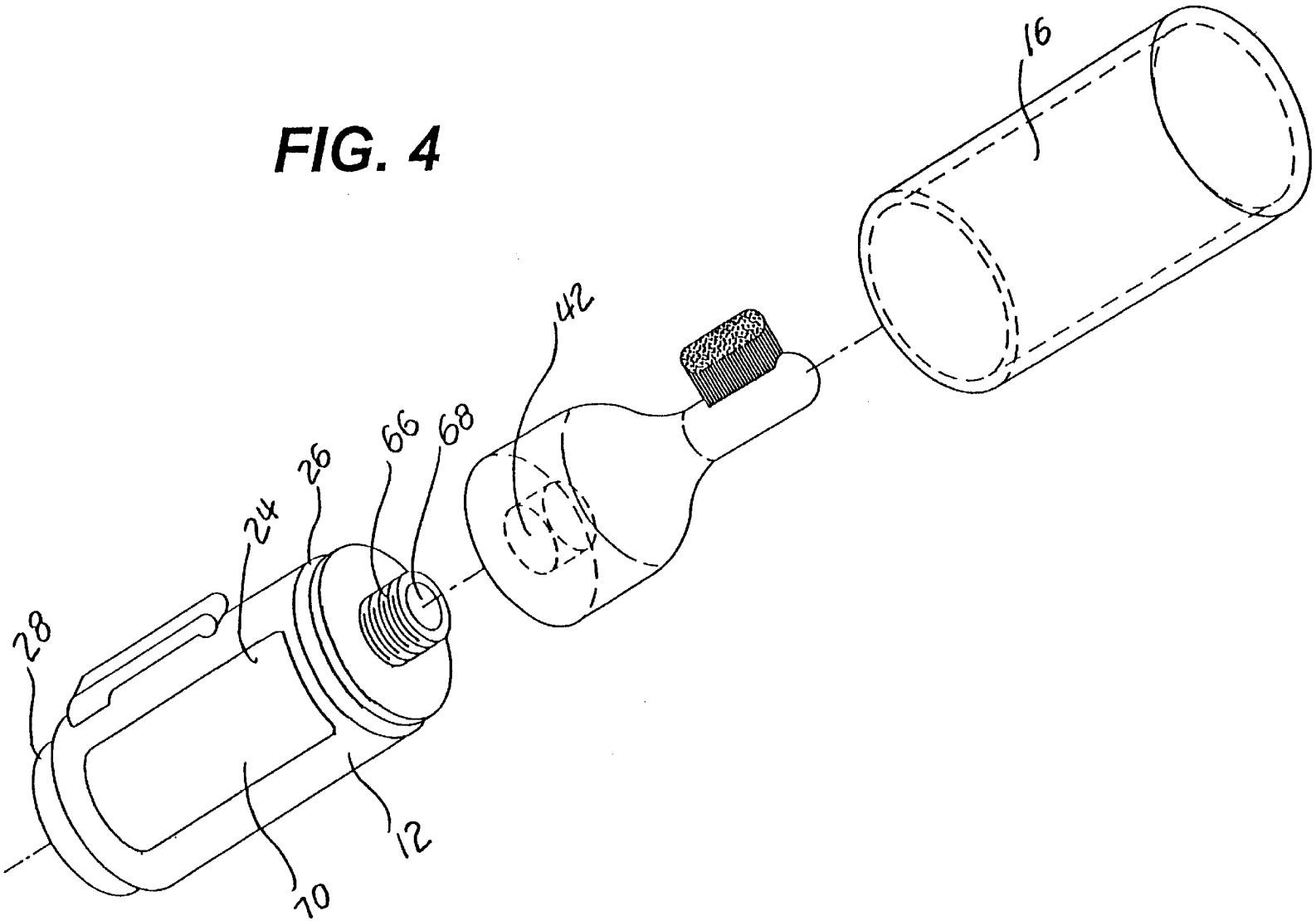
FIG. 4 is a perspective assembly view illustrating an article for oral care according to still another embodiment of the present invention.

FIG. 4 shows still another embodiment of the present invention. As shown therein, the housing 12 comprises a front end 26, a rear end 28, a housing neck 66 having a neck opening 68, and a second opening 24. The housing neck 66 is formed extending from the front end 26. The housing 12 further comprises a flexible side cover 70 to tightly seal the second opening 24 so that a selected amount of tooth paste stored within the housing 12 can be squeezed to flow out of the neck opening 68 by pushing the flexible side cover 70; for example, using a user's finger. Here, the neck 66 is threaded on and along an outer periphery thereof so that the threaded female bore 42 can be tightly fitted over the neck 66 to securely attach the tooth brush section 14 to the housing 12.

The advantages of the article 10 for oral care according to the present invention are numerous. First, the oral care article enables a conventional tooth paste tube to partially serve as a handle of the tooth brush, thereby realizing compactablility.

Second, the threaded neck of a conventional tooth paste tube may be utilized for detachable but safe connection between the tooth brush section and the housing, thereby improving convenience and usability.

Third, the simplified overall construction of the article for oral car according to the present invention may have a clip attached on the housing, thereby realizing portability.

Although the present invention has been described in considerable detail with reference to certain preferred versions thereof, other versions are possible by converting the aforementioned construction. Therefore, the scope of the invention shall not be limited by the specification specified above and the appended claims.

What is claimed is:

1. An article for oral care comprising:

a) a housing having a first opening, a second opening, a front end, a rear end, and a cavity communicating with the first opening and the second opening, wherein the first opening is formed through the front end, wherein a conventional tooth paste tube with a neck can be inserted through the second opening into the cavity, wherein the neck of the tooth paste tube is removably fixed through the first opening while securely holding the tooth paste tube within the housing, and wherein the tooth paste tube can be squeezed through the second opening to allow a desired amount of the tooth paste to flow out of the neck; and b) a tooth brush section having a base, a connecting rod, and a brush, wherein the base comprises a tube end and a brush end, wherein the tube end has a threaded female bore so that the threaded female bore can be tightly fitted over the neck of the tooth paste tube to securely attach the tooth brush section to the housing, wherein the connecting rod is fixedly attached to the base at the brush end and the brush is fixedly attached to the connecting rod.

2. The article of claim 1, further comprising an elongate cap for covering the tooth brush section, wherein the elongate cap has a cap opening and an opening rim, and wherein at least one boss is formed on and along an inner periphery of the opening rim so that the opening rim can be detachably fitted onto the front end of the housing adjacent to the first opening.

3. The article of claim 1, wherein the housing further comprises a clip having a clip base and a clip arm, wherein the clip base is fixedly attached to a predetermined portion of an outer periphery of the housing, and wherein the clip arm is elastically elongated toward the tooth brush section.

4. The article of claim 2, wherein the elongate cap further comprises a clip having a clip base and a clip arm, wherein the clip base is fixedly attached to a predetermined portion of an outer periphery of the elongate cap, and wherein the clip arm is elastically elongated toward the housing.

5. The article of claim 2, wherein the housing further comprises a front extension and a rear extension opposed to the front extension, wherein the front extension is protruded in a decremental step from the front end so that an outer periphery of the front extension can detachably carry thereon the opening rim of the elongate cap.

6. The article of claim 5, wherein the rear extension is protruded in a decremental step from the rear end of the housing so that the an outer periphery of the rear extension can detachably carry thereon the opening rim of the elongate cap.

7. The article of claim 1, wherein the second opening has a length and a width, wherein the width is about one third the outer circumference of the housing, and wherein the length is about two thirds the distance between the front end and the rear end of the housing.

8. An article for oral care comprising:

a) a housing having a first opening, a second opening, a front end, a rear end, and a cavity communicating with the first opening and the second opening, wherein the first opening is formed through the front end, wherein the front end has a pair of protrusions elastically approaching toward each other, forming a hiatus between the pair of protrusions, while channeling the first opening and the second opening, wherein a conventional tooth paste tube with a neck can be inserted through the second opening into the cavity, wherein the neck of the tooth paste tube is removably fixed through the first opening while securely holding the tooth paste tube within the housing, and wherein the tooth paste tube can be squeezed through the second opening to allow a desired amount of the tooth paste to flow out of the neck; and b) a tooth brush section having a base, a connecting rod, and a brush, wherein the base comprises a tube end and a brush end, wherein the tube end has a threaded female bore so that the threaded female bore can be tightly fitted over the neck of the tooth paste tube to securely attach the tooth brush section to the housing, wherein the connecting rod is fixedly attached to the base at the brush end and the brush is fixedly attached to the connecting rod.

9. The article of claim 8, further comprising an elongate cap for covering the tooth brush section, wherein the elongate cap has a cap opening and an opening rim, and wherein at least one boss is formed on and along an inner periphery of the opening rim so that the opening rim can be detachably fitted onto the front end of the housing adjacent to the first opening.

10. The article of claim 8, wherein the housing further comprises a clip having a clip base and a clip arm, wherein the clip base is fixedly attached to a predetermined portion of an outer periphery of the housing, and wherein the clip arm is elastically elongated toward the tooth brush section.

11. The article of claim 9, wherein the elongate cap further comprises a clip having a clip base and a clip arm, wherein the clip base is fixedly attached to a predetermined portion of an outer periphery of the elongate cap, and wherein the clip arm is elastically elongated toward the housing.

12. The article of claim 9, wherein the housing further comprises a front extension and a rear extension opposed to the front extension, wherein the front extension is protruded in a decremental step from the front end so that an outer periphery of the front extension can detachably carry thereon the opening rim of the elongate cap.

13. The article of claim 12, wherein the rear extension is protruded in a decremental step from the rear end of the housing so that the an outer periphery of the rear extension can detachably carry thereon the opening rim of the elongate cap.

14. The article of claim 8, wherein the second opening has a length and a width, wherein the width is about one third the outer circumference of the housing, and wherein the length is about two thirds the distance between the front end and the rear end of the housing.

15. An article for oral care comprising:

a) a housing having a first opening, a second opening, a rear opening, a front end, a rear end, and a cavity communicating with the first opening and the second opening, wherein the first opening is formed through the front end and the rear opening is formed through the rear end, wherein a conventional tooth paste tube with a neck can be inserted through the rear opening into the cavity, wherein the neck of the tooth paste tube is removably fixed through the first opening while securely holding the tooth paste tube within the housing, and wherein the tooth paste tube can be squeezed through the second opening to allow a desired amount of the tooth paste to flow out of the neck; and b) a tooth brush section having a base, a connecting rod, and a brush, wherein the base comprises a tube end and a brush end, wherein the tube end has a threaded female bore so that the threaded female bore can be tightly fitted over the neck of the tooth paste tube to securely attach the tooth brush section to the housing, wherein the connecting rod is fixedly attached to the base at the brush end and the brush is fixedly attached to the connecting rod.

16. The article of claim 15, further comprising an elongate cap for covering the tooth brush section, wherein the elongate cap has a cap opening and an opening rim, and wherein at least one boss is formed on and along an inner periphery of the opening rim so that the opening rim can be detachably fitted onto the front end of the housing adjacent to the first opening.

17. The article of claim 15, wherein the housing further comprises a clip having a clip base and a clip arm, wherein the clip base is fixedly attached to a predetermined portion of an outer periphery of the housing, and wherein the clip arm is elastically elongated toward the tooth brush section.

18. The article of claim 16, wherein the elongate cap further comprises a clip having a clip base and a clip arm, wherein the clip base is fixedly attached to a predetermined portion of an outer periphery of the elongate cap, and wherein the clip arm is elastically elongated toward the housing.

19. The article of claim 15, wherein the second opening has a length and a width, wherein the width is about one third the outer circumference of the housing, and wherein the length is about two thirds the distance between the front end and the rear end of the housing.

20. An article for oral care comprising:

a) a housing having a front end, a rear end, a neck having a neck opening, and a second opening, wherein the neck is formed extending from the front end, wherein the housing further comprises a flexible side cover to tightly seal the second opening so that a selected amount of tooth paste stored within the housing can be squeezed to flow out of the neck opening by pushing the flexible side cover, and wherein the neck is threaded on and along an outer periphery thereof; and b) a tooth brush section having a base, a connecting rod, and a brush, wherein the base comprises a tube end and a brush end, wherein the tube end has a threaded female bore so that the threaded female bore can be tightly fitted over the neck to securely attach the tooth brush section to the housing, wherein the connecting rod is fixedly attached to the base at the brush end and the brush is fixedly attached to the connecting rod.

21. The article of claim 20, further comprising an elongate cap for covering the tooth brush section, wherein the elongate cap has a cap opening and an opening rim, and wherein at least one boss is formed on and along an inner periphery of the opening rim so that the opening rim can be detachably fitted onto the front end of the housing.

22. The article of claim 20, wherein the housing further comprises a clip having a clip base and a clip arm, wherein the clip base is fixedly attached to a predetermined portion of an outer periphery of the housing, and wherein the clip arm is elastically elongated toward the tooth brush section.

23. The article of claim 21, wherein the elongate cap further comprises a clip having a clip base and a clip arm, wherein the clip base is fixedly attached to a predetermined portion of an outer periphery of the elongate cap, and wherein the clip arm is elastically elongated toward the housing.

24. The article of claim 20, wherein the second opening has a length and a width, wherein the width is about one third the outer circumference of the housing, and wherein the length is about two thirds the distance between the front end and the rear end of the housing.

* * * * *